US011009302B1

(12) United States Patent
Mayer et al.

(10) Patent No.: US 11,009,302 B1
(45) Date of Patent: May 18, 2021

(54) CHARGING HANDLE

(71) Applicant: Jason Mayer, Red Oak, TX (US)

(72) Inventors: Jason Mayer, Red Oak, TX (US); Tyler Fricke, Gilbert, AZ (US)

(73) Assignee: Jason Mayer, Red Oak, TX (US)

( * ) Notice: Subject to any disclaimer, the term of this patent is extended or adjusted under 35 U.S.C. 154(b) by 0 days.

(21) Appl. No.: 16/891,341

(22) Filed: Jun. 3, 2020

(51) Int. Cl.

| | |
|---|---|
| ***F41A 3/72*** | (2006.01) |
| ***F41A 35/06*** | (2006.01) |
| *F41G 1/54* | (2006.01) |
| *F41A 15/22* | (2006.01) |

(52) U.S. Cl.
CPC ..... *F41A 3/72* (2013.01); *F41A 35/06* (2013.01); *F41A 15/22* (2013.01); *F41G 1/545* (2013.01)

(58) Field of Classification Search
CPC .. F41A 3/72; F41A 35/06; F41A 15/22; F41G 1/545
USPC ..... 89/1.4
See application file for complete search history.

(56) References Cited

U.S. PATENT DOCUMENTS 7,798,045 B1 * 9/2010 Fitzpatrick ..... F41A 21/481 89/1.4
7,861,635 B1 * 1/2011 Hoel ..... F41A 35/06 89/1.4

OTHER PUBLICATIONS

BlueLineGear.com; "HELM ST-1" product page; https://www.bluelinegear.com/product/Helm-ST1 (Year: 2019).*
ChicagoKnifeWorks.com; "Atlas Dynamic Defense NOC Push Dagger (2")"; https://www.chicagoknifeworks.com/atlas-dynamic-defense-noc-push-dagger-2/ (Year: 2019).*

* cited by examiner

*Primary Examiner* — Samir Abdosh
(74) *Attorney, Agent, or Firm* — Adam R. Stephenson, LTD.

(57) ABSTRACT

Implementations of charging handles may include a central shaft including a bolt engaging mechanism and a hand pull coupled to the central shaft. The hand pull may include a central block. The hand pull may also include a first wing having a first side and a second side, the first side opposite the second side. The hand pull may also include a second wing having a first side and a second side, the first side opposite the second side. The hand pull may also include a first opening extending into the second side of the first wing, a second opening extending into the second side of the second wing, a latch coupled to the second wing, the latch configured to couple within a receiver of a firearm, and a blade directly coupled to the latch, a cutting edge of the blade facing the central block.

20 Claims, 10 Drawing Sheets

CHARGING HANDLE

BACKGROUND

1. Technical Field

Aspects of this document relate generally to firearms, such as rifles. More specific implementations involve charging handles for rifles.

2. Background

A charging handle, also known as a cocking handle or a bolt handle, is a device on a firearm. When operated, the charging handle results in the hammer being cocked and also allows for a round from the magazine to be loaded. The charging handle also is configured to pull back the bolt, allowing for ejection of a spent shell casing.

SUMMARY

Implementations of charging handles may include a central shaft including a bolt engaging mechanism and a hand pull coupled to the central shaft. The hand pull may include a central block having a first side and a second side, the first side opposite the second side. The hand pull may also include a first wing having a first side and a second side, the first side opposite the second side. The first side of the first wing may be directly coupled to the first side of the central block. The hand pull may also include a second wing having a first side and a second side, the first side opposite the second side. The first side of the second wing may be directly coupled to the second side of the central block. The hand pull may also include a first opening extending into the second side of the first wing, a second opening extending into the second side of the second wing, a latch coupled to the second wing, the latch configured to couple within a receiver of a firearm, and a blade directly coupled to the latch, a cutting edge of the blade facing the central block.

Implementations of charging handles may include one, all, or any of the following:

The charging handle may include a first insert configured to couple within the first opening and a second insert configured to couple within the second opening.

The first insert may include one of a front sight adjuster tool, a zeroing red dot tool, an extraction tool, or a pick lock.

The first insert may include one of a front sight adjuster tool, a zeroing red dot tool, an extraction tool, or a pick lock and the second insert may include one of the front sight adjuster tool, the zeroing red dot tool, the extraction tool, or the pick lock.

The first opening and the second opening may be threaded.

The charging handle may be ambidextrous.

Implementations of charging handles may include a central shaft including a bolt engaging mechanism and a hand pull coupled to the central shaft. The hand pull may include a central block having a first side and a second side, the first side opposite the second side. The hand pull may also include a first wing directly coupled to the first side of the central block, a second wing directly coupled to the second side of the central block, and a latch coupled to the second wing, the latch configured to couple within a receiver of a firearm. The charging handle may also include a top attachment configured to couple directly to and over the central block. The top attachment may include a handle, a channel formed in the handle, and a top attachment blade coupled to the handle.

Implementations of charging handles may include one, all, or any of the following:

The charging handle may include a blade coupled between the latch and the central block.

The handle of the top attachment includes a top surface, a bottom surface opposite the top surface, and a first side coupled between the top surface and the bottom surface. The first side may include a recess therein and may be configured to be used as a wrench.

The charging handle may include a plurality of pins coupled to the top attachment, the plurality of pins configured to couple within a plurality of openings included in the central block.

The channel may be configured to be used as a wrench.

The top attachment blade may include a concave tip.

A rear end of the top attachment may include an opening including a hexagonal perimeter. The opening may be configured to be used as a wrench.

Implementations of charging handles may include a central shaft including a bolt engaging mechanism and a hand pull coupled to the central shaft. The hand pull may include a central block having a first side and a second side, the first side opposite the second side. The central block may also include a top surface between the first side and the second side and an opening in the top surface. The hand pull may also include a first wing having a first side and a second side, the first side opposite the second side. The first side of the first wing may be directly coupled to the first side of the central block. The hand pull may also include a second wing having a first side and a second side, the first side opposite the second side. The first side of the second wing may be directly coupled to the second side of the central block. The hand pull may also include a first opening extending into the second side of the first wing, a second opening extending into the second side of the second wing and a latch coupled to the second wing and configured to couple within a receiver of a firearm. The latch may include a blade facing the central block. The hand pull may also include a first insert removably coupled within the first opening, a second insert removably coupled within the second opening, and a top attachment removably coupled directly to and over the central block. The top attachment may include a handle, a pin extending from a bottom side of the top attachment and coupled within the opening of the central block, and a top attachment blade coupled to the handle. A longest length of the top attachment blade may be substantially perpendicular to a longest length of the handle.

Implementations of charging handles may include one, all, or any of the following:

The handle of the top attachment may include a channel configured to be used as a first wrench, an opening configured to be used as a second wrench included in a rear end of the handle, and a recess configured to be used as a third wrench included in a first side of the handle.

The top attachment may be configured to receive a portion of the central block.

The first insert may include either a front sight adjuster tool, a zeroing red dot tool, an extraction tool, or a pick lock and the second insert may include either the front sight adjuster tool, the zeroing red dot tool, the extraction tool, or the pick lock.

The top attachment blade may include a rounded concave tip.

The first side and the second side of the central block may each include a concave recess.

The top attachment may include three different wrenches.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Implementations will hereinafter be described in conjunction with the appended drawings, where like designations denote like elements, and.

DESCRIPTION

This disclosure, its aspects and implementations, are not limited to the specific components, assembly procedures or method elements disclosed herein. Many additional components, assembly procedures and/or method elements known in the art consistent with the intended charging handles will become apparent for use with particular implementations from this disclosure. Accordingly, for example, although particular implementations are disclosed, such implementations and implementing components may comprise any shape, size, style, type, model, version, measurement, concentration, material, quantity, method element, step, and/or the like as is known in the art for such charging handles, and implementing components and methods, consistent with the intended operation and methods.

The implementations of charging handles disclosed herein are configured to couple to a firearm in a manner that allows for the charging handle to pull back the bolt of the firearm. In various implementations, the implementations of the charging handles disclosed herein may be used for rifles, such as, by non-limiting example, a firearm marketed under the tradename AR-15® by Colt's Manufacturing IP Holding Company LLC, of West Hartford Conn., a firearm marketed under the tradename AR-10® by Armalite LLC, of Geneseo Ill., or any other similarly styled rifles.

Figure 1:
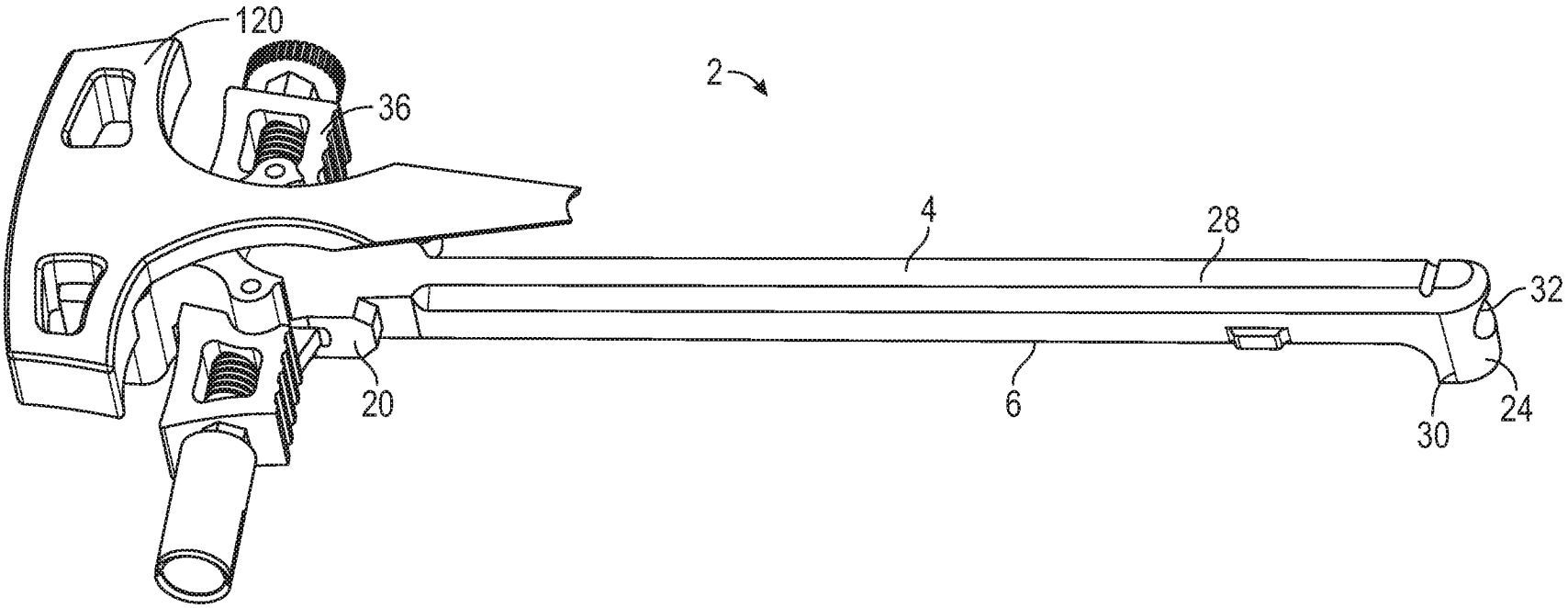
FIG. 1 is a top perspective view of a charging handle.
Figure 2:
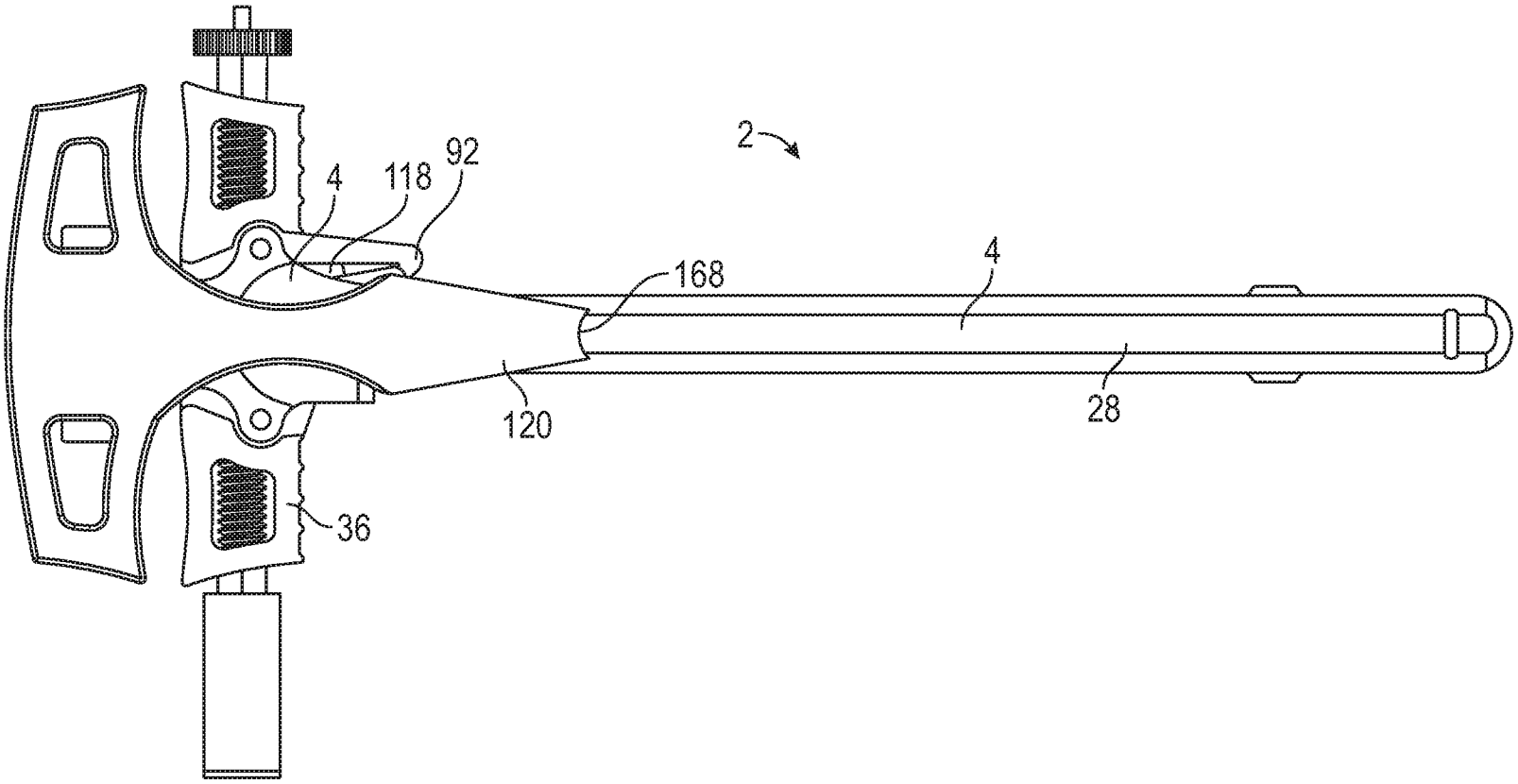
FIG. 2 is a top view of the charging handle of FIG. 1.
Figure 3:
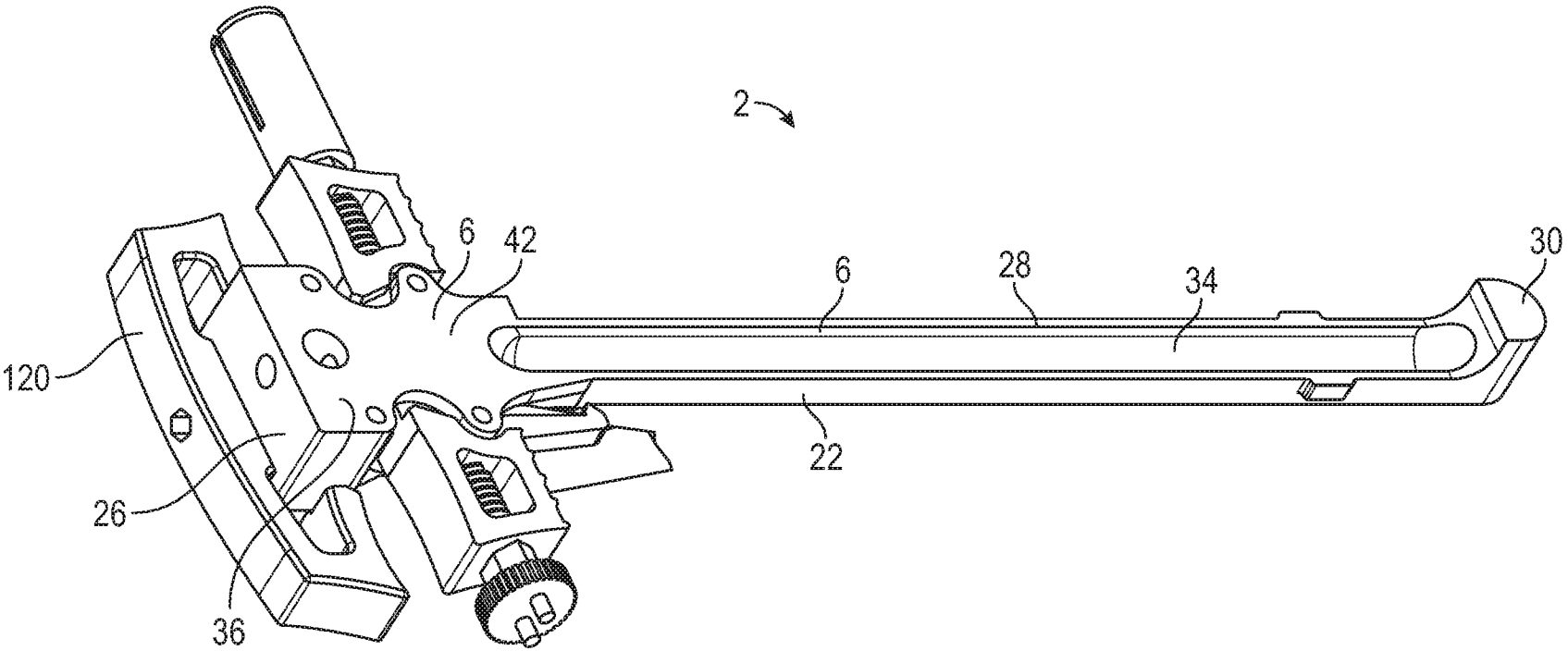
FIG. 3 is a bottom perspective view of the charging handle of FIG. 1.
Figure 13:
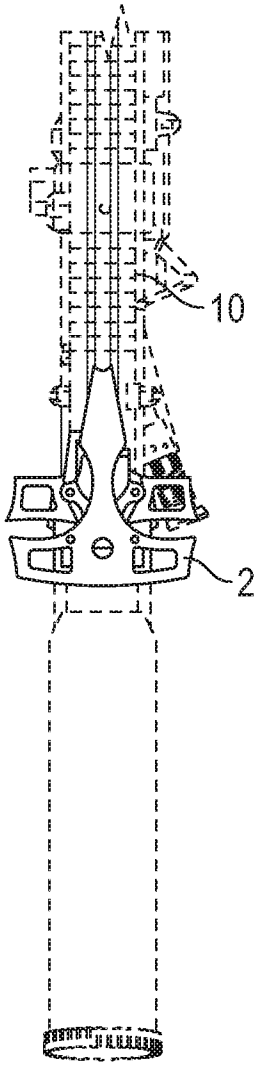
FIG. 13 is a top view of the charging handle of FIG. 1 in a firearm.
Figure 12:
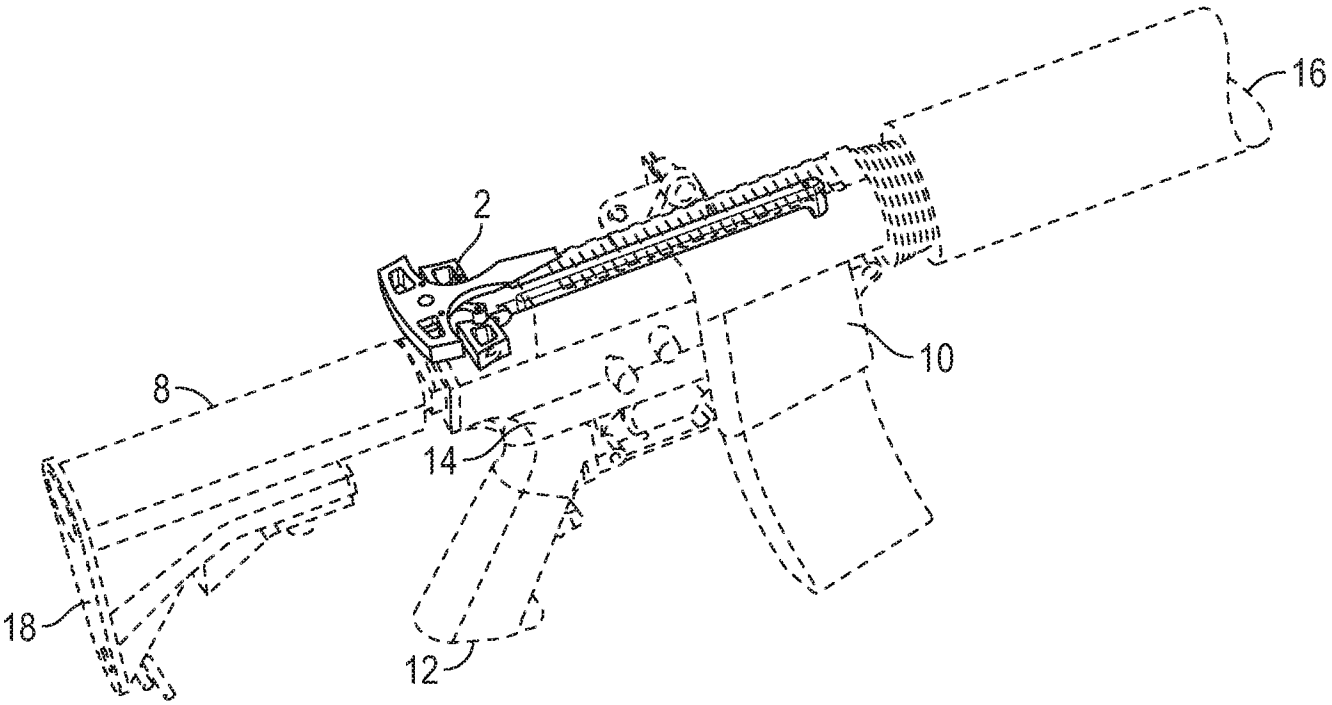
FIG. 12 is a top perspective view of the charging handle of FIG. 1 in a firearm.

Referring to FIG. 1, a top perspective view of a charging handle is illustrated. Referring to FIG. 2, a top view of the charging handle of FIG. 1 is illustrated. Referring to FIG. 3, a bottom perspective view of the charging handle of FIG. 1 is illustrated. As illustrated by FIGS. 1-3, the charging handle 2 includes a top surface 4 and an opposing bottom surface 6. As used herein, "top" refers to the top of the charging handle when the charging handle is inserted into a firearm and the firearm is oriented as illustrated by FIG. 12, which illustrates a top perspective view of the charging handle of FIG. 1 in a firearm. As used herein, the top 8 of the firearm 10 refers to the surface opposite the bottom 12 of the firearm. The firearm 10 includes a first side 14 and a second side opposite the first side. The firearm also includes a front end 16 and a rear end 18 opposite the front end. Similarly, referring back to FIG. 1, the charging handle includes a first side 20 between the top surface 4 and bottom surface 6. Referring to FIG. 3, the charging handle includes a second side 22 opposite the first side. The charging handle also includes a front end 24, as illustrated by FIG. 1, and a rear end 26 opposite the front end, as illustrated by FIG. 3. As illustrated by FIG. 12 and FIG. 13, which illustrates a top view of the charging handle 2 of FIG. 1 in a firearm, implementations of the charging handles disclosed herein are configured to be inserted within a firearm.

Referring to FIGS. 1-3, the charging handle 2 includes a central shaft 28. The central shaft 28 may be made from, by non-limiting example, aluminum, steel, any other metal or alloy thereof, or any other rigid material, including various types of composite materials. The central shaft 28 includes a bolt engaging mechanism 30. The bolt engaging mechanism 30 is configured to couple to a bolt and allow the bolt to be pulled back with the pull of the charging handle 2. As illustrated, the bolt engaging mechanism extends perpendicularly from a longest length of the central shaft 28. In various implementations, and as illustrated by FIG. 1, the bolt engaging mechanism may include an opening 32 extending through the front end 24 of the charging handle 2. As illustrated by FIG. 3, the central shaft 28 may include a channel 34 extending along a length of the central shaft in the bottom surface of the central shaft.

Figure 4:
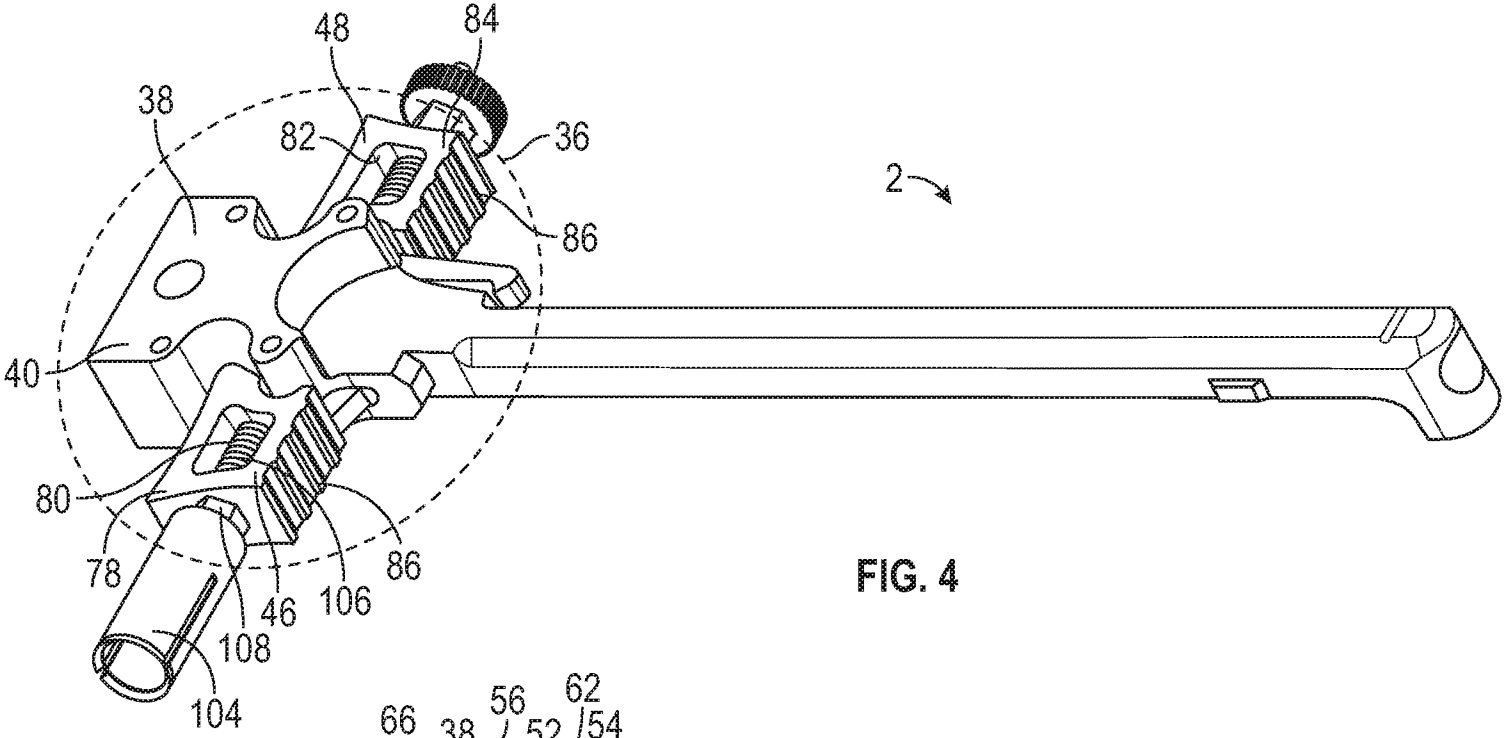
FIG. 4 is a top perspective view of the charging handle of FIG. 1 without the top attachment.
Figure 5:
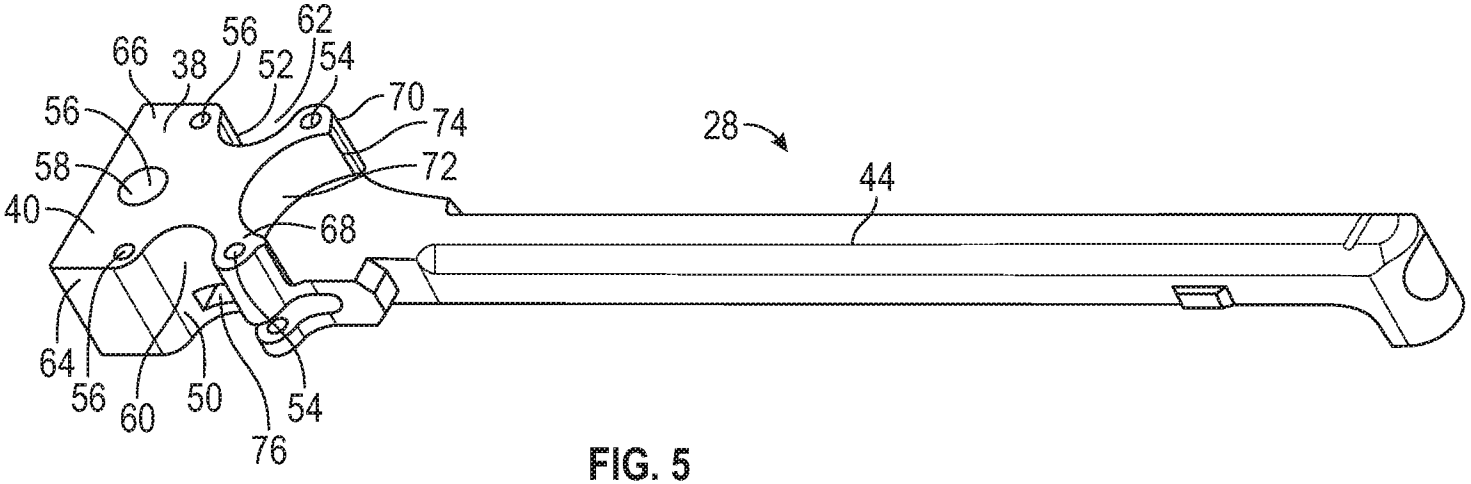
FIG. 5 is a top perspective view of the central shaft of the charging handle of FIG. 1.

As illustrated by FIGS. 1-3, the charging handle 2 includes a hand pull 36 coupled to the central shaft 28. The hand pull 36 is configured to allow a user to grip the hand pull and draw back the charging handle by the hand pull. Referring to FIG. 4, a top perspective view of the charging handle of FIG. 1 without the top attachment is illustrated. Referring to FIG. 4, a clear view of the hand pull 36 is illustrated. In various implementations, the hand pull 36 includes a central block 38. Referring to FIG. 5, a top perspective view of the central shaft of the charging handle of FIG. 1 is illustrated. In various implementations, the central block 38 may be considered as part of the central shaft 28 and may be integrally formed therewith. In other implementations, the central block 38 may be separate from and/or coupled to the central shaft 28. As illustrated by FIG. 5, the central block 38 includes a top surface 40 and a bottom surface 42 opposite the top surface (see FIG. 3). As illustrated by FIG. 5, the central block 38 may include a thickness between the top surface 40 and the bottom surface 42 thicker than a corresponding thickness of the elongate portion 44 of the central shaft 28. Similarly, as illustrated by FIG. 4, the central block 38 may include a thickness between the top surface 40 and the bottom surface 42 thicker than a corresponding thickness of the first wing 46 and the second wing 48. In such implementations, the increased thickness of the central block 38 may facilitate attachment of the top attachment of the charging handle to the central block. In other implementations, the thickness of the central block 38 between the top surface 40 and the bottom surface 42 may be more or less than what is illustrated by FIGS. 4-5. In particular implementations, the thickness of the central block 38 between the top surface 40 and the bottom surface 42 of the central block may be substantially the same as a corresponding thickness of the first wing 46, second wing 48, and/or elongate member 44 of the central shaft 28. In such implementations, the top attachment may attach to the top surface of the central block and be substantially flush with the top surface of the first wing 46, second wing 48, and/or elongate member 44 of the central shaft 28. In other implementations, the central block may have the same thickness as the wings and/or elongate member 44 of the central shaft 28 in implementations not including a top attachment.

Referring back to FIG. 5, the top surface 40 includes a first set of openings 54. The first set of openings 54 may include a first opening adjacent to the first side 50 of the central block and a second opening adjacent to the second side 52 of the central block. The first side is opposite the second side. The set of openings 54 may extend through the central block. In various implementations, the set of openings are configured to receive a set of pins and couple the wings to the central block. By coupling each wing to the central block 38 with only a single pin, the wings are allowed to pivot and release the latch from a notch within the receiver of the firearm. In implementations where the charging handle is not an ambidextrous charging handle, the central block 38 may include only a single opening configured to receive a pin to couple the central block to the wing directly coupled to the latch. In various implementations the top surface 40 of the central block 38 may include a second set of openings 56. As illustrated, the second set of openings may include 3 openings. In other implementations, the second set of openings 56 may include more than three openings, two openings, and in still other implementations, rather than having a second set of openings, the top surface may include an additional single opening. The second set of openings 56 or additional single opening may be blind openings or they may extend through the central block 38. In various implementations, the second set of openings 56 may include a center opening 58 having a larger diameter than the other openings. In other implementations, all of the openings of the second set of openings 56 are the same size. The second set of openings 56 may be configured to receive a set of pins of a top attachment.

In other implementations, the central block 38 may not include a second set of openings 56 in the top surface 40. In such implementations, the top attachment may be coupled to the central block through another attachment mechanism or the charging handle may not include a top attachment.

In various implementations the first side 50 of the central block may include a first concave recess 60 formed therein. Similarly, the second side 52 of the central block may also include a second concave recess 62 formed therein. In other implementations, the first side 50 and/or the second side 52 may not include a concave recess. In implementations having the first concave recess 60 in the first side 50, the first concave recess 60 may form a first tab 64 in the central block. Similarly, in implementations having the second concave recess 62, the second concave recess may form a second tab 66 in the central block 38.

Still referring to FIG. 5, in various implementations the central block 38 may include a first arm 68 and a second arm 70. In various implementations, the first arm 68 may be formed between the first concave recess 60 and a third concave recess 72 formed in a front end 74 of the central block 38. Similarly, the second arm 70 may be formed between the second concave recess 62 and the third concave recess 72. As illustrated, the first arm 68 and the second arm 70 may each included a rounded end configured to be received by a corresponding wing, as illustrated by FIG. 4. In such implementations, the rounded wing may allow for the wings to still pivot enough in order for the latch to be released from the receiver of the firearm. In other implementations, the front end 74 of the central block 38 may not include the third concave recess 72.

In implementations of an ambidextrous charging handle, the central block 38 may include an opening 76 extending from the first side 50 of the central block to the second side 52 of the central block. The opening 76 may be configured to receive and allow for the first wing 46 to engage with the second wing 48, allowing for the first wing 46 to be pulled, apply pressure to the second wing 48 causing it to pivot, and release the latch directly coupled to the second wing from the receiver of the firearm. In other implementations having just a right or left handed charging handle, the central block may not include the opening 76 extending from the first side 50 to the second side 52 of the central block 38. Rather, the central block may include a blind opening in either the first side 50 or the second side 52 configured to receive a single wing and allow the single wing to pivot.

Referring to FIG. 4, the first wing 46 of the pull handle 36 may be directly coupled to the first side 50 of the central block, and may be at least partially received by the first concave recess 60. Similarly, the second wing 48 of the pull handle 36 may be directly coupled to the second side 52 of the central block 38, and may be at least partially received by the second concave recess 62. The first wing 46 includes a top surface 78 and a bottom surface opposite the top surface. In various implementations, the first wing 46 may include an opening 80 extending from the top surface 78 to the bottom surface. In various implementations, the second wing 48 may include a similar opening 82 extending from the top surface 84 of the second wing to the bottom surface opposite the top surface. In such implementations, the openings may reduce the overall weight of the charging handle.

Still referring to FIG. 4, in various implementations the first wing 46 and/or second wing 48 may include a plurality of ridges 86 formed on the front end of the first wing 46 and/or the second wing 48. In such implementations, the plurality of ridges 86 may provide grip to facilitate a user pulling back the charging handle 2.

Figure 6:
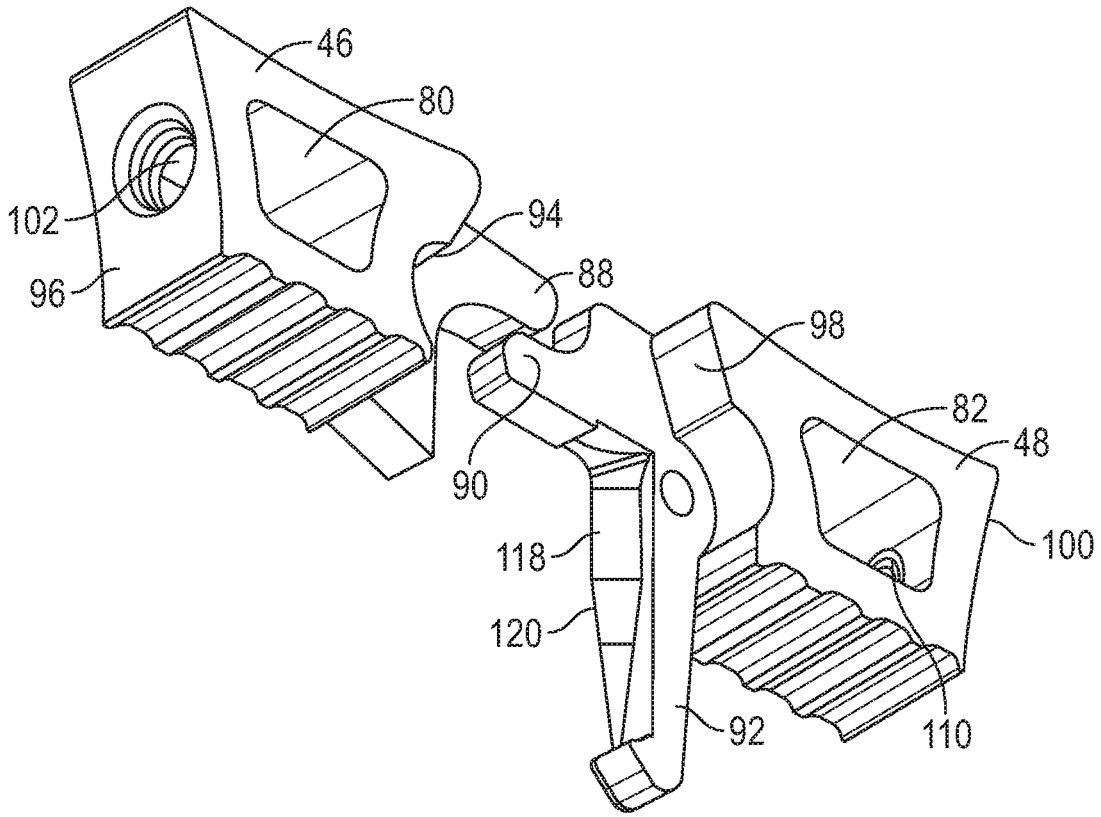
FIG. 6 is a perspective view of the wings of FIG. 1.

Referring to FIG. 6, a perspective view of the wings of FIG. 1 are illustrated. As illustrated, the wings are configured for use with an ambidextrous charging handle inasmuch as the first wing 46 includes a first internal arm 88 and the second wing includes a second internal arm 90. Upon the first wing 46 being pulled, the first wing pivots and the first internal arm pushes against the second internal arm 90, causing the second wing 48 to pivot and the latch 92 to be released from a notch in the receiver of the firearm.

As illustrated by FIG. 6, the first wing 46 includes a first side 94 and a second side 96 opposite the first side. The first side 94 is configured to directly couple to the first side 50 of the central block 38, as illustrated by FIG. 4. Similarly, the second wing 48 includes a first side 98 and a second side 100 opposite the first side. The first side 98 is configured to directly couple to the second side 52 of the central block 38, as illustrated by FIG. 4. In various implementations, the second side 96 of the first wing 46 may include a first opening 102 extending therein. In implementations having opening 80, the first opening 102 may extend to the opening 80. In various implementations, and as illustrated by FIG. 6, the first opening may be threaded. In other implementations the first opening 102 may not be threaded.

Referring back to FIG. 4, the charging handle 2 may include a first insert 104 configured to be removably received in the first wing 46 through the first opening 102. In such implementations, the first insert 104 may include a threaded portion 106 in order to allow the first insert 104 to screw into the first opening 102. In various implementations, the first insert may include a portion 108 having a hexagonal perimeter.

Figure 8:
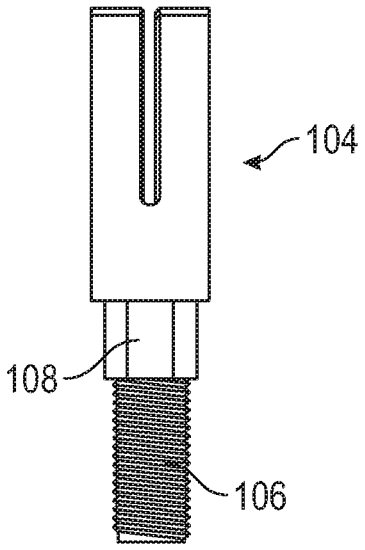
FIG. 8 is a view of an extraction tool.

As illustrated by FIG. 4, the first insert 104 may be an extraction tool. Referring to FIG. 8, a view of the extraction tool of FIG. 4 is illustrated. In various implementations, the extraction tool may be configured to couple around a lip of a casing and extract a casing from a firearm. In such implementations, a casing may be cleared from the firearm by pulling the back end of the casing rather than pushing the front end of the casing from the muzzle end of the firearm. In other implementations, the first insert may be, by non-limiting example, a zero red dot sight tool, any other type of front sight adjuster tool, a pick lock, such as a city rake, a punch, a Philips screw driver head, a flat head screw driver head, a star tipped screw driver head, a hexagonal screw driver head, a can opener, or a take-down tool for a pistol or any other type of firearm. In such implementations, the first insert may be removed from the first wing 46 and the hexagonal portion may be inserted into a corresponding hexagonal opening in the top attachment. The top attachment may then be used with the first insert to allow the user to use the first insert. In other implementations, the first insert may not include a hexagonal portion, rather the threaded portion 106 may be threaded into a corresponding opening in the top attachment.

Referring back to FIG. 6, In various implementations, the second side 100 of the second wing 48 may include a second opening 110 extending therein. In implementations having opening 82, the second opening 110 may extend to the opening 82. In various implementations, and as illustrated by FIG. 6, the second opening 110 may be threaded. In other implementations the second opening 110 may not be threaded.

Referring back to FIG. 4, the charging handle 2 may include a second insert 112 configured to be removably received in the second wing 48 through the second opening 110. In such implementations, the second insert 112 may include a threaded portion 114 in order to allow the second insert 112 to screw into the second opening 110. In various implementations, the second insert may include a portion 116 having a hexagonal perimeter.

Figure 7:
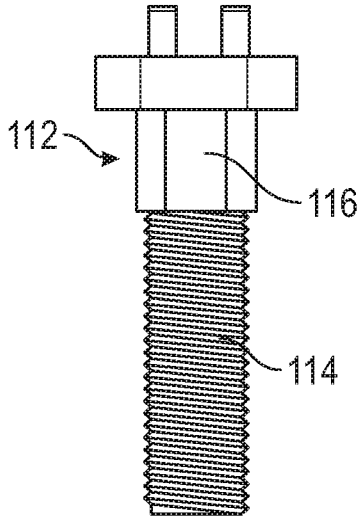
FIG. 7 is a view of a front sight tool.

As illustrated by FIG. 4, the second insert 112 may be a front sight tool. Referring to FIG. 7, a view of the front sight tool of FIG. 4 is illustrated. In other implementations, the second insert may be, by non-limiting example, any type of insert disclosed herein. In such implementations, the second insert 112 may be removed from the second wing 48 and the hexagonal portion 116 may be inserted into a corresponding hexagonal opening in the top attachment. The top attachment may then be used with the second insert 112 to allow the user to use the second insert. In other implementations, the second insert 112 may not include a hexagonal portion, rather the threaded portion 114 may be threaded into a corresponding opening in the top attachment.

While implementations of the charging handle 2 disclosed herein include the first insert and second insert, in other implementations the first insert and second insert may be considered as separate from the charging handle. Further, in other implementations the charging handle 2 may not include a first insert 104 and second insert 112, or a first opening 102 in the first wing 46 and a second opening 110 in the second wing 48.

Referring back to FIGS. 2 and 6, the charging handle 2 includes a latch 92. The latch, as illustrated by FIG. 6, is directly coupled to the second wing 48 and extends from the second wing in a direction substantially parallel to the central shaft. The latch 92 is configured to latch into a notch of the receiver of a firearm. In various implementations, the charging handle 2 may include a blade 118 directly coupled to the latch 92 and coupled between the latch and the central block 38. While the blade may be attached to the latch in various implementations, in other implementations the blade is integrally formed with and considered part of the latch. The blade 118 includes a cutting edge 120 facing the central block 38. In implementations including the blade 118, the charging handle 2 may be used as a seatbelt cutter. This may be particularly useful in implementations where the firearm is stored on a user's person in a vehicle, such as is often the case for military personnel. When needed, a seatbelt may be inserted between the latch 92 and the central block 38, and upon a downward movement of the firearm, the seatbelt may be cut by the blade 118. In other implementations, the charging handle does not include a blade coupled between the latch 92 and the central block 38.

Figure 9:
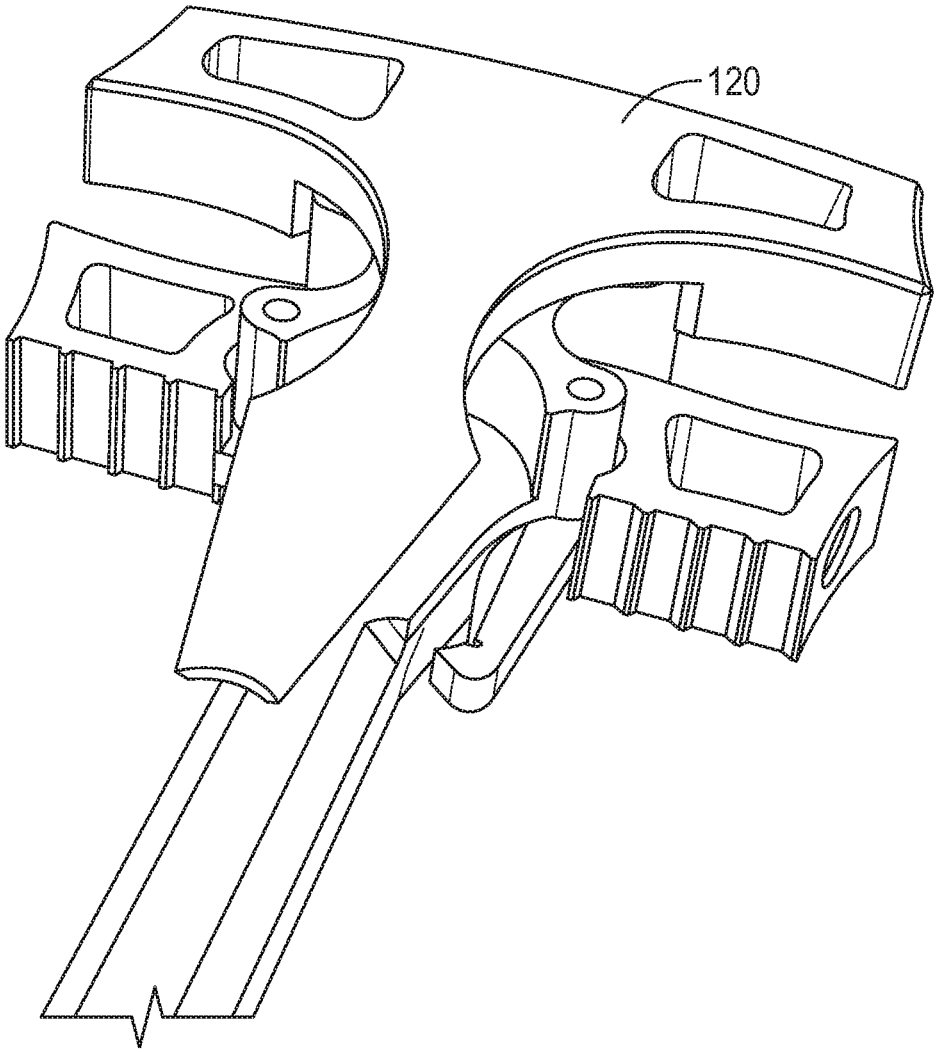
FIG. 9 is a magnified view of the top attachment of FIG. 1 coupled to the pull handle.
Figure 10:
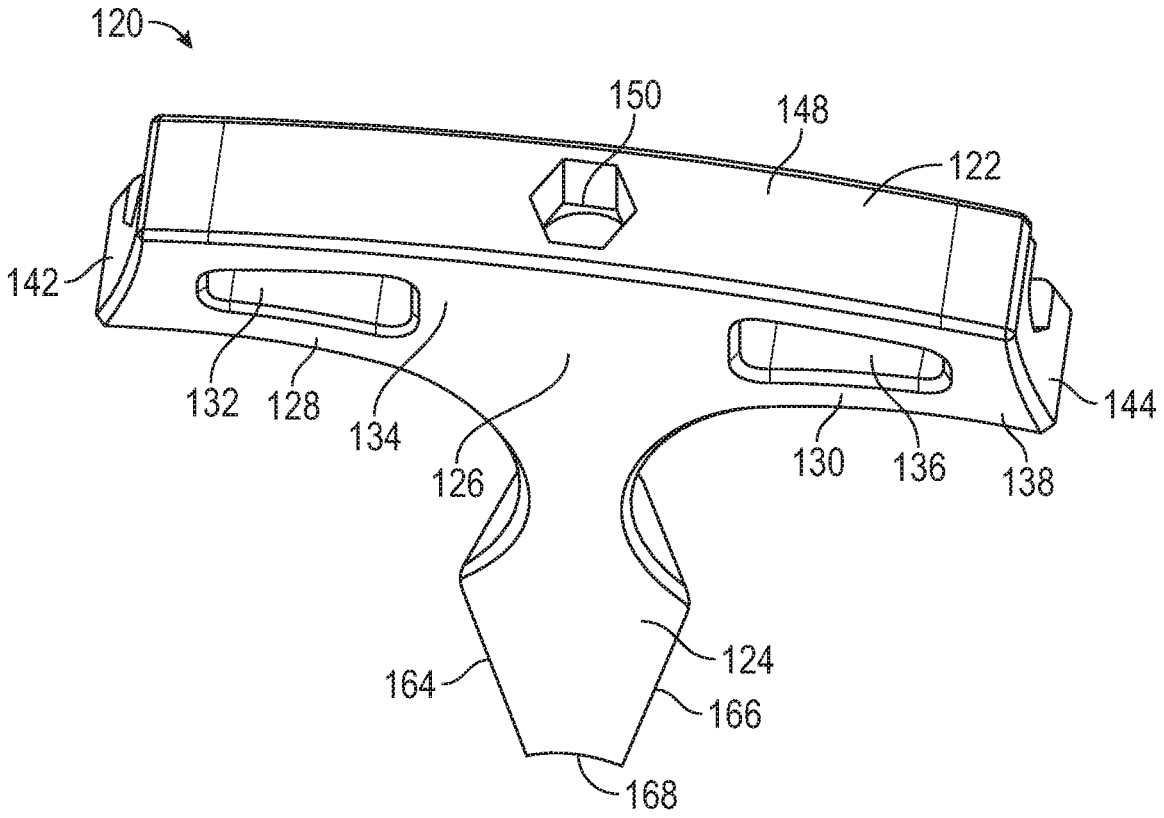
FIG. 10 is a top, rear view of the top attachment of FIG. 1.
Figure 11:
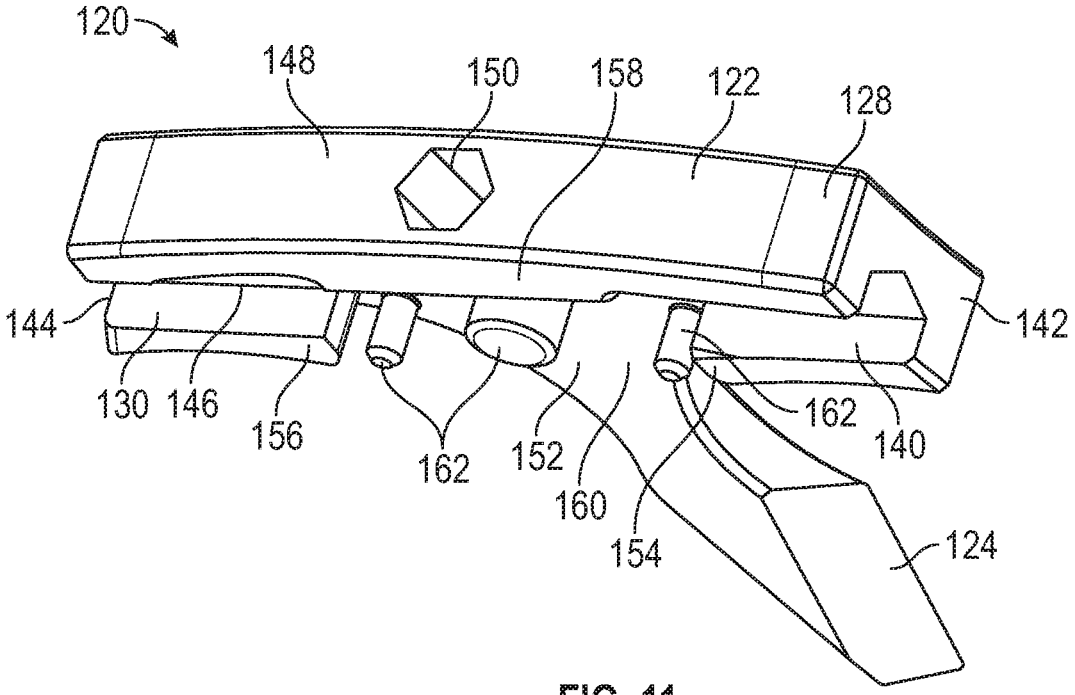
FIG. 11 is a bottom, rear view of the top attachment of FIG. 1.

Referring back to FIGS. 1-3, the charging handle 2 includes a top attachment 120 removably and directly coupled to the top surface 40 of the central block 38. Referring to FIG. 9, a magnified view of the top attachment of FIG. 1 coupled to the pull handle is illustrated. Referring to FIG. 10, a top, rear view of the top attachment of FIG. 1 is illustrated. Referring to FIG. 11, a bottom, rear view of the top attachment of FIG. 1 is illustrated. As illustrated by FIGS. 10-11, the top attachment 120 includes a handle 122 coupled to a top attachment blade 124. In various implementations, the top attachment blade extends from a center 126 of the handle 122 and may include a longest length substantially perpendicular to a longest length of the handle 122. In such implementations, the handle top attachment may be symmetrical across a plane extending along a length of the center of the top attachment blade. Accordingly, a first portion 128 of the handle may be the same length as a second portion 130 of the handle. In other implementations the top attachment blade may be coupled to a non-center portion of the handle. In such implementations, the first portion 128 of the handle 122 may be longer or shorter than the second portion 130 of the handle.

As illustrated by FIGS. 10-11, the first portion 128 of the handle 122 may include a first opening 132 extending from a top surface 134 of the top attachment to a bottom surface of the top attachment 120, the bottom surface opposite the top surface. Similarly, in various implementations the second portion 130 of the handle 122 may include a second opening 136 extending from a top surface 138 of the top attachment to a bottom surface of the top attachment 120, the bottom surface opposite the top surface. In other implementations, the handle may not include any openings extending into the top surface 138. Referring to FIG. 11, in various implementations the first portion 128 of the handle 122 may include a first channel 140 extending from a first side 142 of the handle towards the second side 144 of the handle. Similarly, in various implementations the second portion 130 of the handle 122 may include a second channel 146 extending from the second side 144 towards the first side 142 of the handle 122. In various implementations, the end of either channel may be configured to receive a hexagonal portion of either the first or second insert of any insert disclosed herein. In such implementations, the top attachment 120 may be removed from the charging handle 2 and the top attachment 120 may be configured to be the handle for the first or second insert when the first or second insert is removed from the wings of the charging handle and inserted into the top attachment. Further, in such implementations, either the first or second channel may be used as a wrench. In various implementations, the channels may include various widths. In such implementations the first channel may form a first sized wrench and the second channel may form a second wrench having either a larger or smaller size than the wrench formed by the first channel. In various implementations, the handle 122 may include only a single channel. In other implementations, the handle 122 does not include a first channel extending to the first end 142 of the handle or a second channel 146 extending to the second end of the channel 144. In various implementations, the first end 142 of the handle 122 may include an opening configured to receive an insert and the second end 144 of the handle may include an opening configured to receive an insert. In still other implementations, the first and second end of the handle may not be configured to receive an insert or be used as a wrench.

Still referring to FIGS. 10-11, the rear end 148 of the handle 122 may include an opening 150. The opening 150 may include a hexagonal perimeter and may be configured to receive the hexagonal portion of any insert disclosed herein. The hexagonal perimeter may also be configured to be used as a socket wrench. In such implementations, the top attachment 120 may be removed from the charging handle 2, an insert may be removed from the charging handle, and the handle 122 may be configured to be a handle for an insert when the insert is used by a user. In other implementations, the opening 150 may be threaded and may be configured to receive a threaded portion of any insert disclosed herein. In still other implementations, the handle 122 does not include an opening in the rear end 148 of the handle 122.

As illustrated by FIG. 11, the top attachment 120 may include a portion 152 configured to receive a portion of the central block 38. In such implementations, a pressure fit may be formed between the central block 38 and an end of a wall 154 of the first channel 140, an end of a wall 156 of the second channel 146, and/or a rear wall 158 of the handle 122. In various implementations, the bottom surface 160 of the top attachment 120 may include one or more pins 162 extending from the top attachment 120. The pins may be configured to insert within the second set of openings 56 of the central block 38, as illustrated by FIG. 5. The number of pins within the one or more pins and the size of the pins may correspond to the number of the openings within the second set of openings 56 (or the single opening in implementations having only one opening) and the size of the openings (or opening). In such implementations, the top attachment may be removably secured to the central block 38 through a pressure fit formed between the one or more pins 162 and the second set of openings 56. In other implementations, rather than the top attachment including pins and the central block including the openings to receive the pins, the central block may include one or more pins and the top attachment may include one or more openings configured to receive the one or more pins and removably secure the top attachment to the central block. In still other implementations, other coupling mechanisms may be used to couple the central block to the top attachment.

Still referring to FIGS. 10-11, the top attachment includes a top attachment blade 124. In various implementations, and as illustrated, the top attachment blade may be a double edged blade and may include a first cutting edge 164 and a second cutting edge 166. In other implementations, the top attachment blade may include only a single cutting edge. Any of the edges may be smooth or serrated.

As illustrated by FIGS. 10 and 2, the top attachment blade may include a tip 168. In various implementations, the tip 168 may be a concave tip. The concave tip may include a curve corresponding to the curve of a casing fired by the firearm the charging handle is inserted within. Accordingly, the top attachment 120 may be used as an extraction tool to remove casings stuck within the port of the firearm. Further, the top attachment 120 may also be used as a push dagger.

Figure 14:
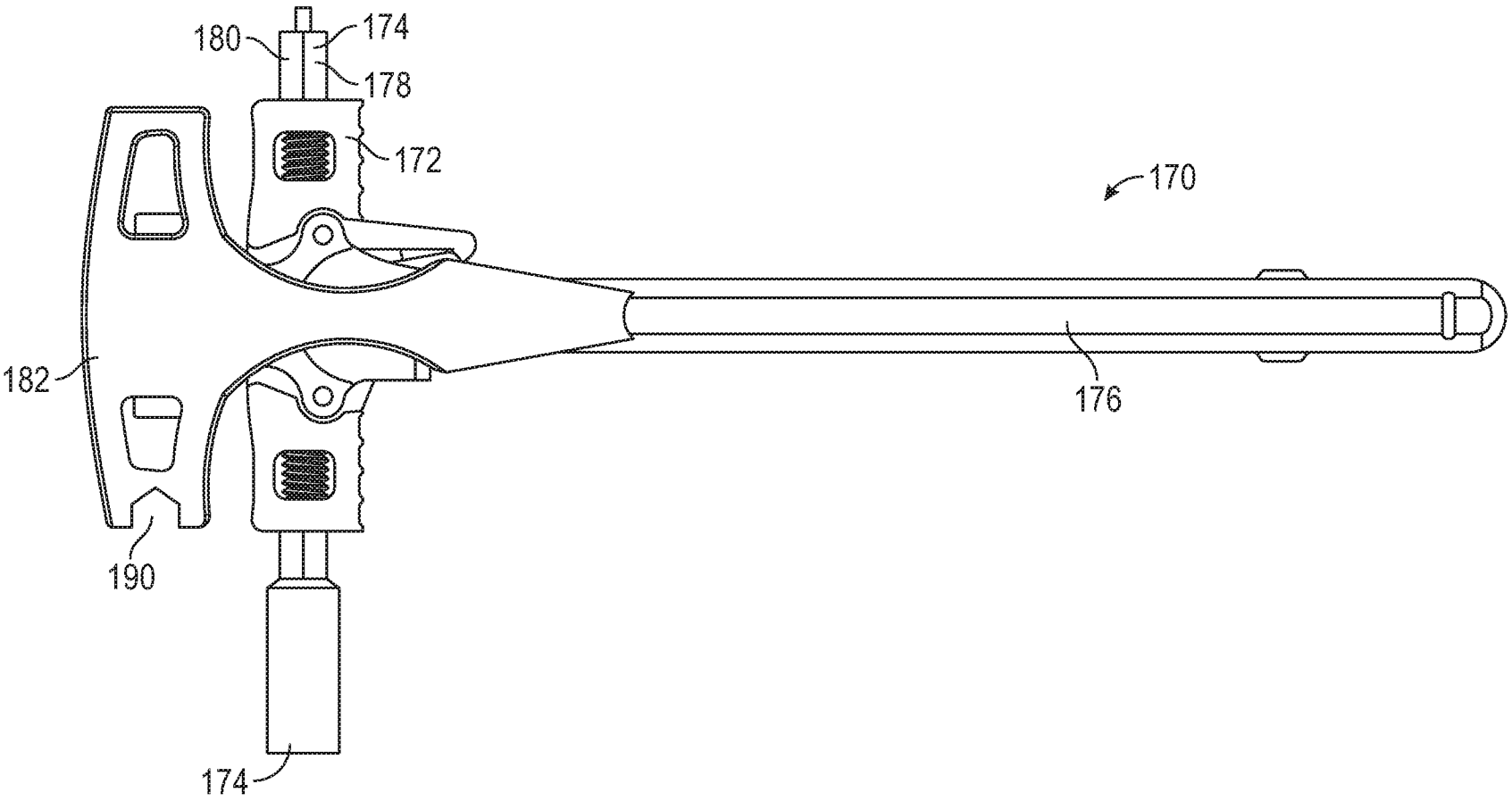
FIG. 14 is a top view of another implementation of a charging handle.

Referring to FIG. 14, a top view of another implementation of a charging handle is illustrated. In various implementations the charging handle 170 may include a pull handle 172, inserts 174, and central shaft 176 that are the same as or similar to any pull handle, central shaft, and inserts disclosed herein. As illustrated by FIG. 14, the charging handle may include an aim-point sight adjuster tool 178. As illustrated, the sight adjuster tool 178 may include a longer hexagonal portion 180 than what is illustrated by the front sight adjuster tool of FIG. 7.

Figure 15:
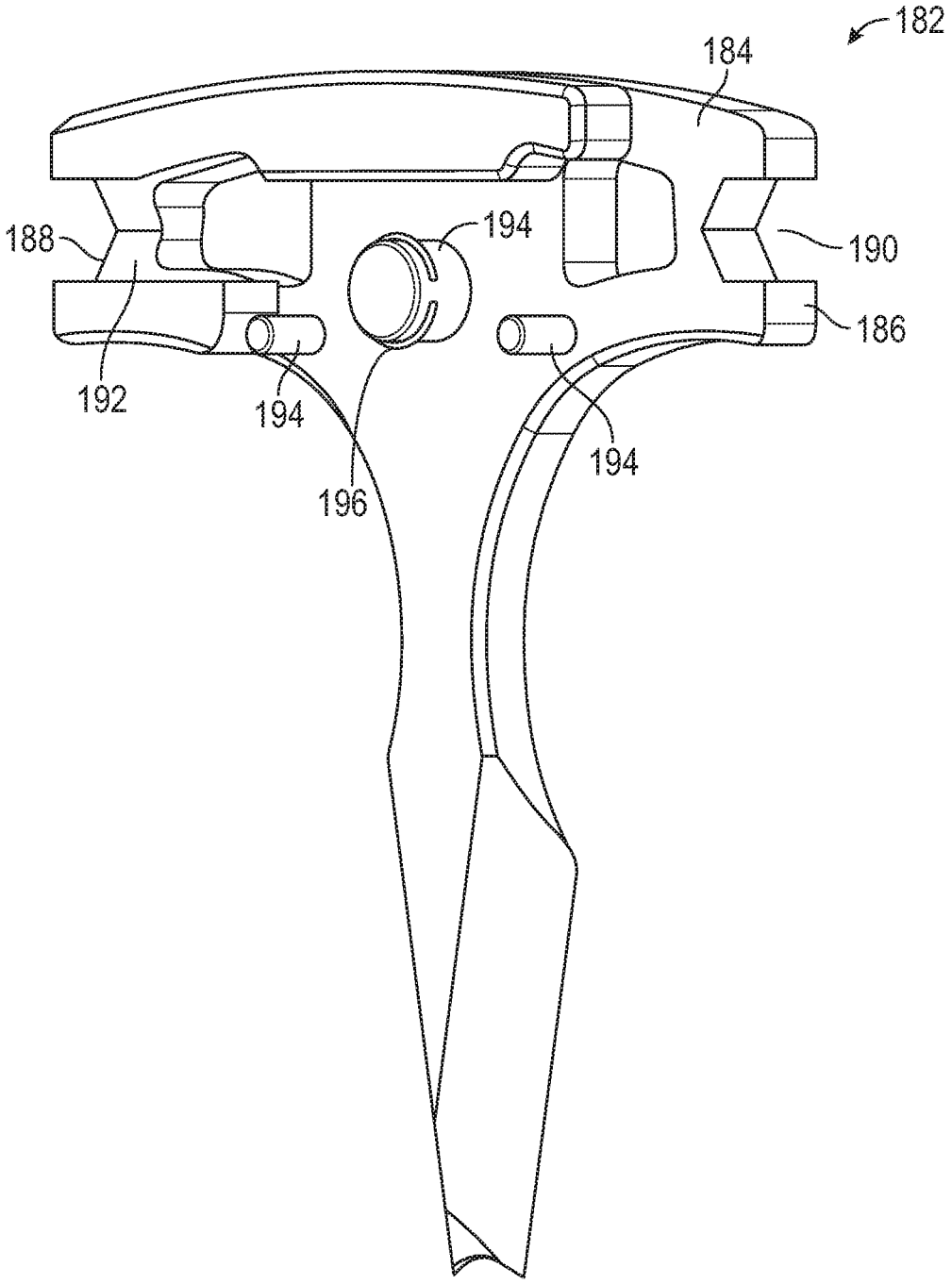
FIG. 15 is a side, bottom perspective view of the top attachment of FIG. 14.

As illustrated by FIG. 14, the charging handle 170 includes a top attachment 182. Referring to FIG. 15, a side, bottom view of the top attachment of FIG. 14 is illustrated. In various implementations, the top attachment 182 may include a handle 184 having a first side 186 and a second side 188 opposite the first side. In various implementations, the first side 186 may include a recess 190 therein. The recess 190 may form a wrench in the handle 184. In various implementations, and as illustrated, the handle may also include a channel 192 extending to the second side 188. Similar to the implementations disclosed herein, the channel 192 may form an additional wrench. In particular implementations, the channel 192 may form a wrench having a wider diameter than the wrench formed by the recess 190. In other implementations, the wrench formed by the recess 190 may include a wider diameter than the wrench formed by the channel 192. In other implementations, the handle of the top attachment does not include any channels, but rather includes a recess in the second side 188 of the handle similar to the recess 190 in the first side 186 of the handle. In such implementations, the two recesses may form two differently sized wrenches.

As illustrated by FIG. 15, the top attachment 182 may include one or more pins 194 configured to couple within a central block. In various implementations, any of the one or more pins 194, or any other pins disclosed herein, may include a spring clip 196 coupled to an end of any of the one or more pins 194.

Any other elements of the charging handle 170 may be the same as or similar to any other element of any other charging handle disclosed herein.

In any of the implementations disclosed herein, the top attachment may include three wrenches. In such implementations, the top attachment may include a wrench in the rear end of the handle, a wrench in the first side of the handle, and a wrench in the bottom surface of the handle (within the channel of the handle). Other implementations may include top attachments having less than three wrenches.

In other implementations, the charging handle 2 does not include a top attachment.

In various implementations, the charging handle 2 may be included as part of a charging handle kit. In such implementations, the kit may include more than two inserts, including between 3-12 inserts. In other implementations, the kit may include more than 12 inserts. The inserts may be any disclosed herein. In such implementations, the user may be able to select the desired insert and may be able to switch out the inserts when other inserts are desired to be coupled to and carried with the charging handle.

In places where the description above refers to particular implementations of charging handles and implementing components, sub-components, methods and sub-methods, it should be readily apparent that a number of modifications may be made without departing from the spirit thereof and that these implementations, implementing components, sub-components, methods and sub-methods may be applied to other charging handles.

What is claimed is:

1. A charging handle comprising:
- a central shaft comprising a bolt engaging mechanism;
- a hand pull coupled to the central shaft, the hand pull comprising:
  - a central block comprising a first side and a second side, the first side opposite the second side;
  - a first wing comprising a first side and a second side, the first side opposite the second side, wherein the first side of the first wing is directly coupled to the first side of the central block;
  - a second wing comprising a first side and a second side, the first side opposite the second side, wherein the first side of the second wing is directly coupled to the second side of the central block;
  - a first opening extending into the second side of the first wing;
  - a second opening extending into the second side of the second wing;
  - a latch coupled to the second wing, the latch configured to couple within a receiver of a firearm; and
  - a blade directly coupled to the latch, a cutting edge of the blade facing the central block.

2. The charging handle of claim 1, further comprising a first insert configured to couple within the first opening and a second insert configured to couple within the second opening.

3. The charging handle of claim 2, wherein the first insert comprises one of a front sight adjuster tool, a zeroing red dot tool, an extraction tool, or a pick lock.

4. The charging handle of claim 2, wherein the first insert comprises one of a front sight adjuster tool, a zeroing red dot tool, an extraction tool, or a pick lock and the second insert comprises one of the front sight adjuster tool, the zeroing red dot tool, the extraction tool, or the pick lock.

5. The charging handle of claim 1, wherein the first opening and the second opening are threaded.

6. The charging handle of claim 1, wherein the charging handle is ambidextrous.

7. A charging handle comprising:
- a central shaft comprising a bolt engaging mechanism;
- a hand pull coupled to the central shaft, the hand pull comprising:
  - a central block comprising a first side and a second side, the first side opposite the second side;
  - a first wing directly coupled to the first side of the central block;
  - a second wing directly coupled to the second side of the central block; and
  - a latch coupled to the second wing, the latch configured to couple within a receiver of a firearm;
- a top attachment configured to couple directly to and over the central block, the top attachment comprising:
  - a handle;
  - a channel formed in the handle; and
  - a top attachment blade coupled to the handle.

8. The charging handle of claim 7, further comprising a blade coupled between the latch and the central block.

9. The charging handle of claim 7, wherein the handle of the top attachment comprises a top surface, a bottom surface opposite the top surface, and a first side coupled between the top surface and the bottom surface, wherein the first side comprises a recess therein and is configured to be used as a wrench.

10. The charging handle of claim 9, further comprising a plurality of pins coupled to the top attachment, the plurality of pins configured to couple within a plurality of openings comprised in the central block.

11. The charging handle of claim 7, wherein the channel is configured to be used as a wrench.

12. The charging handle of claim 7, wherein the top attachment blade comprises a concave tip.

13. The charging handle of claim 7, wherein a rear end of the top attachment comprises an opening comprising a hexagonal perimeter, wherein the opening is configured to be used as a wrench.

14. A charging handle comprising:
- a central shaft comprising a bolt engaging mechanism;
- a hand pull coupled to the central shaft, the hand pull comprising:
  - a central block comprising:
    - a first side and a second side, the first side opposite the second side;
    - a top surface between the first side and the second side; and
    - an opening in the top surface;
  - a first wing comprising a first side and a second side, the first side opposite the second side, wherein the first side of the first wing is directly coupled to the first side of the central block;
  - a second wing comprising a first side and a second side, the first side opposite the second side, wherein the first side of the second wing is directly coupled to the second side of the central block;
  - a first opening extending into the second side of the first wing;
  - a second opening extending into the second side of the second wing;
  - a latch coupled to the second wing and configured to couple within a receiver of a firearm, the latch comprising a blade extending towards the central block;
- a first insert removably coupled within the first opening;
- a second insert removably coupled within the second opening; and
- a top attachment removably coupled directly to and over the central block, the top attachment comprising:
  - a handle;
  - a pin extending from a bottom side of the top attachment and coupled within the opening of the central block; and
  - a top attachment blade coupled to the handle;
  - wherein a longest length of the top attachment blade is substantially perpendicular to a longest length of the handle.

15. The charging handle of claim 14, wherein the handle of the top attachment further comprises a channel configured to be used as a first wrench, an opening configured to be used as a second wrench comprised in a rear end of the handle, and a recess configured to be used as a third wrench comprised in a first side of the handle.

16. The charging handle of claim 15, wherein the top attachment is configured to receive a portion of the central block.

17. The charging handle of claim 14, wherein the first insert comprises one of a front sight adjuster tool, a zeroing red dot tool, an extraction tool, or a pick lock and the second insert comprises one of the front sight adjuster tool, the zeroing red dot tool, the extraction tool, or the pick lock.

18. The charging handle of claim 14, wherein the top attachment blade comprises a rounded concave tip.

19. The charging handle of claim 14, wherein the first side and the second side of the central block each comprise a concave recess.

20. The charging handle of claim 14, wherein the top attachment comprises three different wrenches.

* * * * *